US009248498B2

(12) United States Patent
Noda et al.

(10) Patent No.: US 9,248,498 B2
(45) **Date of Patent: *Feb. 2, 2016**

(54) METHOD FOR AUTOMATICALLY POURING MOLTEN METAL BY TILTING A LADLE AND A MEDIUM FOR RECORDING PROGRAMS FOR CONTROLLING A TILT OF A LADLE

(75) Inventors: Yoshiyuki Noda, Toyohashi (JP); Kazuhiko Terashima, Toyohashi (JP); Ryusuke Fukushima, Toyohashi (JP); Makio Suzuki, Toyokawa (JP); Kazuhiro Ota, Toyokawa (JP); Hiroyasu Makino, Toyokawa (JP)

(73) Assignees: SINTOKOGIO, LTD., Nagoya-Shi; NATIONAL UNIVERSITY CORPORATION TOYOHASHI UNIVERSITY OF TECHNOLOGY, Toyohashi-Shi ( * ) Notice: Subject to any disclaimer, the term of this patent is extended or adjusted under 35 U.S.C. 154(b) by 478 days.

This patent is subject to a terminal disclaimer.

(21) Appl. No.: 13/642,316

(22) PCT Filed: Jan. 26, 2011

(86) PCT No.: PCT/JP2011/051478

§ 371 (c)(1), (2), (4) Date: Oct. 19, 2012

(87) PCT Pub. No.: WO2011/132442

PCT Pub. Date: Oct. 27, 2011

(65) Prior Publication Data

US 2013/0041493 A1 Feb. 14, 2013

(30) Foreign Application Priority Data

Apr. 22, 2010 (JP) ..... 2010-098401

(51) Int. Cl.
*G06F 19/00* (2011.01)
*C21B 15/00* (2006.01)
(Continued)

(52) U.S. Cl.
CPC ..... *B22D 41/06* (2013.01); *B22D 35/04* (2013.01); *B22D 37/00* (2013.01)

(58) Field of Classification Search
CPC ..... B22D 41/06; B22D 35/04; B22D 37/00; B22D 46/00; G06F 17/50; G06F 19/00; Y02T 10/82
USPC ..... 700/97, 103, 204; 266/23, 45, 99, 44, 266/96; 222/59, 60, 96; 164/13, 45
See application file for complete search history.

(56) References Cited

U.S. PATENT DOCUMENTS 8,114,338 B2 * 2/2012 Noda et al. ..... 266/44
2008/0196856 A1 * 8/2008 Terada et al. ..... 164/136
(Continued)

FOREIGN PATENT DOCUMENTS

JP 2005-088041 4/2005
JP 2008-272802 11/2008
JP 4328326 6/2009

OTHER PUBLICATIONS

International Search Report dated Mar. 22, 2011; PCT/JP2011/051478; one page.

*Primary Examiner* — Mohammad Ali
*Assistant Examiner* — Md Azad
(74) *Attorney, Agent, or Firm* — Farabow, Garrett & Finnegan, Henderson, Dunner, L.L.P.

(57) ABSTRACT

A method for controlling the respective input voltages transmitted to a servomotor that tilts the ladle such that the molten metal that flows from the ladle drops accurately into the pouring gate in the mold, a servomotor that moves the ladle back and forth, and a servomotor that moves the ladle up and down, by using a computer. In the method, a mathematical model of the area on which the molten metal that flows from the ladle will drop is produced, and then the inverse problem of the produced mathematical model is solved. In view of the effect of a contracted flow, the position on which molten metal drops is estimated by the estimating device for estimating the pouring rate and the estimating device for estimating the position on which molten metal will drop.

6 Claims, 6 Drawing Sheets

(51) Int. Cl.

| | |
|---|---|
| ***C21B 7/12*** | (2006.01) |
| ***C21B 7/24*** | (2006.01) |
| ***B67D 7/84*** | (2010.01) |
| ***B22D 35/00*** | (2006.01) |
| ***B22D 45/00*** | (2006.01) |
| ***B22D 41/00*** | (2006.01) |
| ***B22D 37/00*** | (2006.01) |
| ***G04C 1/12*** | (2006.01) |
| ***G04C 23/00*** | (2006.01) |
| ***B22D 23/00*** | (2006.01) |
| ***B22D 41/06*** | (2006.01) |
| ***B22D 35/04*** | (2006.01) |

(56) References Cited

U.S. PATENT DOCUMENTS

| | | | | |
|---|---|---|---|---|
| 2010/0059555 | A1 | 3/2010 | Noda et al. | |
| 2012/0043706 | A1* | 2/2012 | Tamotsu | 266/165 |

* cited by examiner

Flow rate per unit with q

METHOD FOR AUTOMATICALLY POURING MOLTEN METAL BY TILTING A LADLE AND A MEDIUM FOR RECORDING PROGRAMS FOR CONTROLLING A TILT OF A LADLE

TECHNICAL FIELD

The present invention generally relates to a casting technique, and specifically to a tilting-type method for automatically pouring molten metal, such as molten iron and molten aluminum, into a mold by tilting a ladle that retains a specific amount of the molten metal.

BACKGROUND OF THE INVENTION

Conventionally, (1) a method to suppress vibrations of molten metal while it is being conveyed to a position for pouring it; (2) a method to suppress vibrations of molten metal that are caused by backwardly tilting it after the pouring is finished; (3) a method to control the speed of tilting a ladle such that a certain pouring rate is kept; (4) a method for quickly pouring a specific weight of molten metal; (5) a method for controlling the speed of tilting a ladle such that a targeted pouring rate is achieved; (6) a method for increasing an amount of molten metal that flows from a ladle in an early phase of the pouring by raising and lowering an outflow position of the ladle; (7) a tilting-type method for automatically pouring molten metal by using a fuzzy control; and (8) a tilting-type method for automatically pouring molten metal by using a fluctuation model with linear parameters, etc., are known as tilting-type methods for automatically pouring molten metal.

Conventionally, an apparatus based on methods (1) and (2) can prevent the surface of molten metal from vibrating while a ladle is being conveyed and while the ladle is being tilted. However, the methods do not relate to achieving a targeted flow rate while the molten metal is being poured. Methods (3) and (5) can control a weight poured of molten metal per unit of time. A specific weight of molten metal can be accurately poured by methods (4), (6), and (7). Method (6) is a pouring method for increasing the amount of the molten metal that flows from a ladle by lowering an outflow position of the ladle such that the time for casting is shortened. Those methods are the pouring methods that can accurately control the pouring rate and the weight of the poured molten metal. However, the position where the poured molten metal drops is not controlled by these tilting-type pouring methods. So, there is a problem in that the poured molten metal may drop outside a pouring gate of a mold. As a method for solving the problem, a method for controlling the position on which a liquid which flows out of a ladle drops by means of a feedforward control is known (see Patent document 1). The method given in Patent document 1 is effective. However, in the method, the position on which the liquid drops should be more accurately controlled.

Patent document 1: JP2008-272802

DISCLOSURE OF INVENTION

The purpose of the present invention is to provide a pouring method for allowing the molten metal that flows from a ladle to drop accurately on a pouring gate in a mold and to provide a medium that records a program for controlling the tilt of a ladle.

To achieve that purpose, the method, of the present invention, for automatically pouring molten metal by tilting a ladle is characterized in that, in a tilting-type automatic pouring apparatus comprising three servomotors, one of which can tilt the ladle, one of which can move the ladle back and forth, and one of which can move the ladle up and down, the molten metal that flows from the ladle is accurately dropped into a pouring gate in a mold when the molten metal is poured into the mold, by controlling the respective input voltages transmitted to the three servomotors by means of a computer. The method comprises the following: a step for producing a mathematical model of an area on which the molten metal that flows from the ladle will drop; a step for solving an inverse problem of the produced mathematical model in view of the effect of a contracted flow by means of an estimating device for estimating the flow rate of the poured molten metal and by means of an estimating device for estimating the position on which the molten metal drops, to estimate a position on which the molten metal drops; a step for calculating the estimated position by means of a computer to thereby obtain respective input voltages transmitted to the three servomotors; and a step for controlling the three servomotors based on the obtained input voltages.

Also, the medium of the present invention that records a program for controlling the automatic pouring of molten metal by tilting a ladle that retains the molten metal is characterized in that, in a tilting-type automatic pouring apparatus comprising three servomotors, one of which can tilt the ladle, one of which can move the ladle back and forth, and one of which can move the ladle up and down, the molten metal that flows from the ladle is correctly dropped into a pouring gate in a mold when the molten metal is poured into the mold, by controlling the respective input voltages transmitted to the three servomotors that are controlled by means of a computer. The program comprises the following: a step for producing a mathematical model of an area on which the molten metal that flows from the ladle will drop; a step for solving an inverse problem of the produced mathematical model in view of the effect of a contracted flow by means of an estimating device for estimating a flow rate of the poured molten metal and by means of an estimating device for estimating a position on which the molten metal drops, to calculate an estimated position on which the molten metal drops; a step for calculating the estimated position by means of a computer to thereby obtain respective input voltages transmitted to the three servomotors; and a step for controlling the three servomotors based on the obtained input voltages.

Incidentally, the mathematical model used in the present invention is a method in which the intended function that is controlled by a computer, such as a function that relates to a profit and a cost, is obtained by solving a formula, such as a heat balance, a material balance, a chemical reaction, a restrictive condition, etc., of the process, and then carrying out a control for achieving their maximum and minimum. Also, incidentally a cylindrical ladle or a ladle whose vertical cross section is fan-like is used in the present invention. The ladle is supported near its center of gravity. Further, a "contracted flow" means that the depth of the overflowing molten metal is reduced at the tip of the outflow position under the effect of gravity.

In the present invention, the molten metal that flows from the ladle can be accurately poured into the pouring gate in the mold by moving the ladle back and forth to control the position on which the molten metal drops. Thereby the molten metal can be prevented from dropping outside the pouring gate in the mold. This is advantageous, because the molten metal can be poured safely and without being wasted.

DETAILED DESCRIPTION OF THE INVENTION

Hereafter, the best mode for carrying out the present invention is explained. Before explaining the best mode, a preceding example in which a feedforward control is used is first explained with reference to FIGS. 1 to 8. Then a tilting-type automatic pouring apparatus to which the present invention is applied will be explained with reference to FIGS. 9, 10, and 11.

[1. A Tilting-Type Automatic Pouring Apparatus of the Preceding Example]

Figure 1:
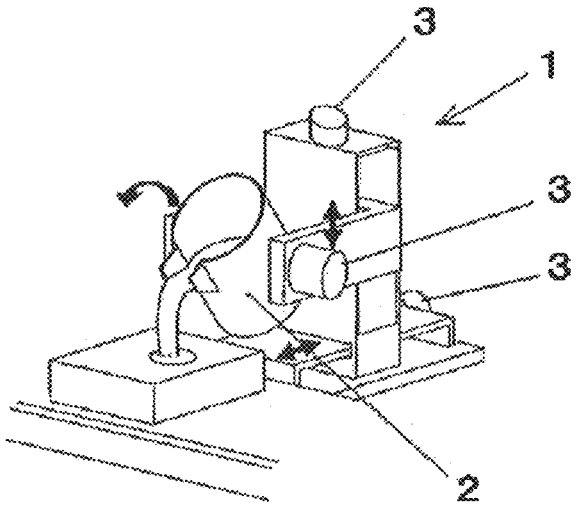
FIG. 1 schematically illustrates the tilting-type automatic pouring apparatus used in the preceding example, which is explained before the present invention is explained.

The apparatus in FIG. 1 is a schematic diagram of the tilting-type automatic pouring apparatus of the preceding example. The tilting-type automatic pouring apparatus 1 of the preceding example has a ladle 2. The ladle 2 can be tilted, can be moved back and forth, and can be moved up and down, by means of servomotors 3, 3, which are installed in respective positions of the tilting-type automatic pouring apparatus 1. Respective rotary encoders are attached to the servomotors 3, 3. So, the position and the angle of the ladle 2 can be measured. Further, the servomotors 3, 3 receive a controlling command signal by a computer. Incidentally, the term "computer" means a motion controller, such as a personal computer, a microcomputer, a programmable logic controller (PLC), and a digital signal processor (DSP).

Figure 2:
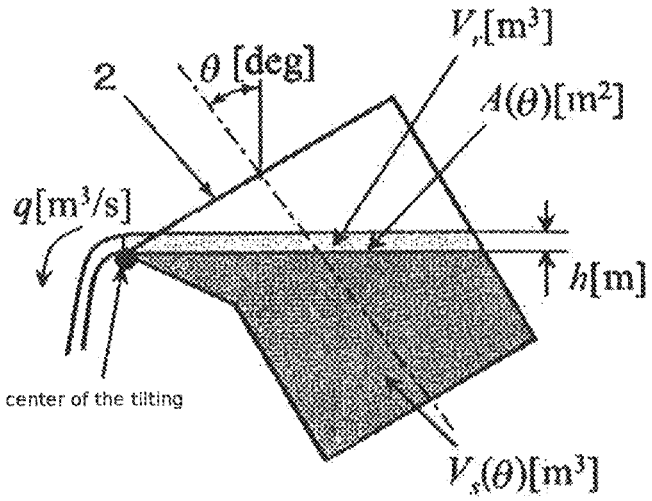
FIG. 2 illustrates a vertical cross section of the ladle in the automatic pouring apparatus of FIG. 1.
Figure 3:
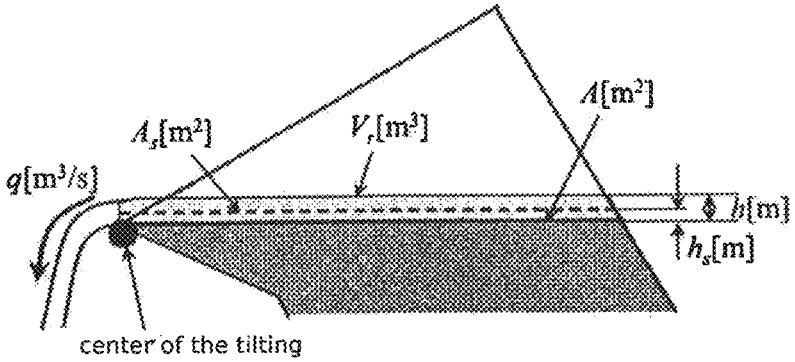
FIG. 3 is an enlarged and detailed view of the important part in FIG. 2.

In FIG. 2, which shows a vertical cross section of the ladle 2 while it is pouring the molten metal, given that θ [degree] is the angle of the tilting of the ladle 1, Vs (θ) [$m^3$] is the volume of the molten metal (a darkly shaded region) below the line which runs horizontally through the outflow position, which is the center of the tilting of the ladle 2, A (θ) [$m^2$] is the horizontal area on the outflow position (the area bordering the horizontal area between the darkly shaded region and the lightly shaded region), Vr [$m^3$] is the volume of the molten metal above the outflow position (the lightly shaded region), h [m] is the height of the molten metal above the outflow position, and q [$m^3$/s] is the rate of the flow of the molten metal that flows from the ladle 2, then the expression that denotes the balance of the molten metal in the ladle 2 from the time t [a] to the Δt [a] after t [s] is given by the following expression (1):

$$Vr(t)+Vs(\theta(t))=Vr(t+\Delta t)+Vs(\theta(t+\Delta t))+q(t)\Delta t \tag{1}$$

If expression (1) is changed to another expression that denotes Vr [$m^3$] and Δt is caused to be 0, the following expression (2) is obtained.

$$\lim_{\Delta t\to 0}\frac{V_r(t+\Delta t)-V_r(t)}{\Delta t}=\frac{dV_r(t)}{dt}=-q(t)-\frac{dV_s(\theta(t))}{dt}=-q(t)-\frac{\partial V_s(\theta(t))}{\partial\theta(t)}\frac{d\theta(t)}{dt} \tag{2}$$

Also, the angular velocity of the tilting of the ladle 2, ω [degree/3], is defined by the following expression (3):

$$\omega(t)=d\theta(t)/dt \tag{3}$$

If expression (3) is substituted for the terms in expression (2), then expression (4) is obtained.

$$\frac{dV_r(t)}{dt}=-q(t)-\frac{\partial V_s(\theta(t))}{\partial\theta(t)}\omega(t) \tag{4}$$

Also, the volume of the molten metal above the outflow position Vr [$m^3$] is given by the following expression (5):

$$V_r(t)=\int_0^{h(t)}A_s(\theta(t),h_s)dh_s \tag{5}$$

Area As [$m^2$] shows the horizontal area of the molten metal at the distance above the horizontal area on the outflow position, $h_s$ [m].

If area As [$m^2$] is broken down into the horizontal area of the outflow position A [$m^2$] and the amount of the change of area ΔAs [$m^2$] over the area A [$m^2$], then the volume Vr [$m^3$] is given by the following expression (6).

$$V_r(t)=\int_0^{h(t)}(A(\theta(t))+\Delta A_s(\theta(t),h_s))dh_s=A(\theta(t))h(t)+\int_0^{h(t)}\Delta A_s(\theta(t),h_s)dh_s \tag{6}$$

With ladles in general, including the ladle 2, because the amount of the change of the area ΔAs [$m^2$] is very small compared to the horizontal area on the outflow position, A [$m^2$] the following expression (7) is obtained:

$$A(\theta(t))h(t)>>\int_0^{h(t)}\Delta A_s(\theta(t),h_s)dh_s \tag{7}$$

Thus expression (6) can be shown as the following expression (8):

$$V_r(t)\approx A(\theta(t))h(t) \tag{8}$$

Then the following expression (9) is obtained from expression (8):

$$h(t)\approx V_r(t)/A(\theta(t)) \tag{9}$$

Figure 4:
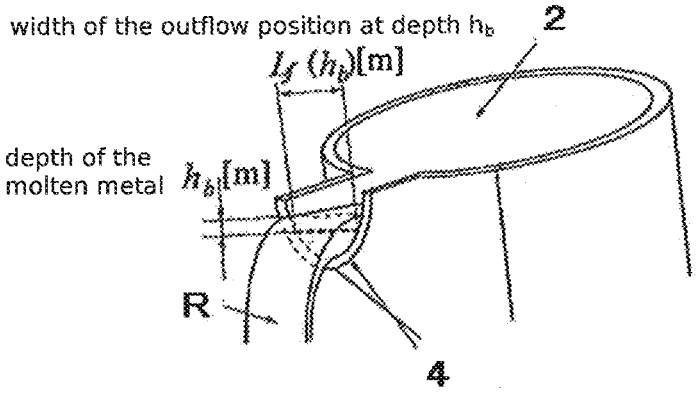
FIG. 4 illustrates the tip of the outflow position.

The rate of the flow of the molten metal q [$m^3$/s] that flows from the ladle 2 at height h [m] above the outflow position is obtained from Bernouilli's theorem. It is given by the following expression (10), $$q(t)=c\int_0^{h(t)}(L_f(h_b)\sqrt{2gh_b})dh_b,\ (0<c<1) \tag{10}$$

wherein, as shown in FIG. 4, $h_b$ [m] is the depth of the molten metal from its surface in the ladle 2, $L_f$ [m] is the width of the outflow position at depth $h_b$ [m] of the molten metal, c is a coefficient of the flow of the molten metal that flows out, and g is the gravitational acceleration.

Further, the following expressions (11) and (12), which show the basic model of the expression for the flow of the molten metal, are obtained from expressions (4), (9) and (10):

$$\frac{dV_r(t)}{dt} = -c\int_0^{\frac{V_r(t)}{A(\theta(t))}}\left(L_f(h_b)\sqrt{2gh_b}\right)dh_b - \frac{\partial V_s(\theta(t))}{\partial\theta}\omega(t) \tag{11}$$

$$q(t) = c\int_0^{\frac{V_r(t)}{A(\theta(t))}}\left(L_f(h_b)\sqrt{2gh_b}\right)dh_b,\ (0 < c < 1) \tag{12}$$

Also, since the width $L_f$ [m] of the rectangular outflow position of the ladle 2 is constant to the depth $h_b$ [m] as measured from the upper surface of the molten metal in the ladle 2, the rate of the flow of the molten metal, q [$m^3$/s], is given by the following expression (13) from formula (10).

$$q(t)=\tfrac{2}{3}cL_f\sqrt{2g}h(t)^{3/2},\ (0<c<1) \tag{13}$$

So, given that formula (13) is substituted for the basic models (11) and (12) for the pouring rate, the basic models for the pouring rate of the ladle 2 are given by the following formulas (14) and (15).

$$\frac{dV_r(t)}{dt} = -\frac{2cL_f\sqrt{2g}}{3A(\theta(t))^{3/2}}V_r(t)^{3/2} - \frac{\partial V_s(\theta(t))}{\partial\theta}\omega(t) \tag{14}$$

$$q(t) = \frac{2cL_f\sqrt{2g}}{3A(\theta(t))^{3/2}}V_r(t)^{3/2},\ (0 < c < 1) \tag{15}$$

Figure 5:
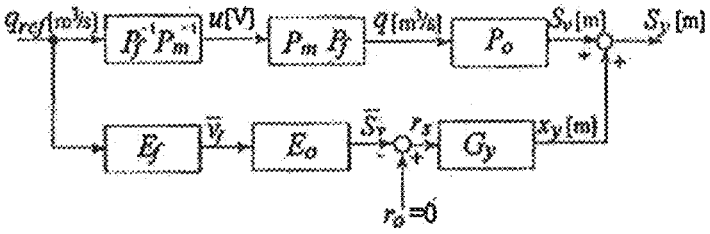
FIG. 5 is a block diagram illustrating a system for controlling a position on which molten metal drops in the preceding example.

FIG. 5 illustrates a block diagram of a system for controlling the position on which the molten metal drops. $q_{ref}$ [$m^3$/s] shows a curve of the targeted flow rate pattern, u[V] shows the input voltage to a motor, and $P_m$ and $P_f$ show the dynamic characteristics of the motor and the pouring process, respectively.

$P_f^{-1}$ shows an inverse model of the pouring rate. $P_m^{-1}$ shows an inverse model of the motor. A system for carrying out a feedforward control of the pouring rate by using the inverse models of the pouring process is applied such that the actual pouring rate follows the targeted flow rate pattern $q_{ref}$. Incidentally, the feedforward control is a method of control that can provide a targeted output by adjusting an input amount applied to the controlled system to a predetermined value. The feedforward control can achieve an excellent control if the relationship between the input and the output in the controlled system is known, or if the effect of a disturbance, etc., is known.

Figure 6:
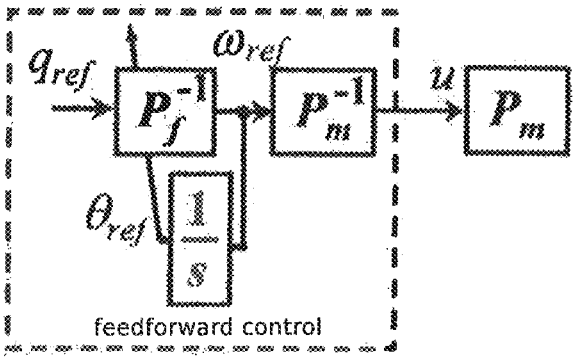
FIG. 6 is a block diagram of the system of the feedforward control of the pouring rate.

FIG. 6 is a block diagram of the controlling system in a system for obtaining a controlling input u[V] that is transmitted to the servomotors 3, 3 to achieve a targeted pouring rate pattern $Q_{ref}$ [$m^3$/s]. The inverse model $P_m^{-1}$ of the servomotors 3, 3 is given by the following formula (16).

$$u(t) = \frac{T_m}{K_m}\frac{d\omega_{ref}(t)}{dt} + \frac{1}{K_m}\omega_{ref}(t) \tag{16}$$

The inverse model for the basic expression of the pouring rate as shown in formula (11) and formula (12) will be obtained. The pouring rate, q [$m^3$/s], in relation to the height of the molten metal above the outflow position h [m], can be obtained from formula (10), which is Bernoulli's theorem. The maximum height, $h_{max}$ [m], is divided equally by n. Each part of the divided height is denoted by Δh [m], wherein $h_{max}$ [m] is the height above the outflow position when from the shape of the ladle 2 the volume above the outflow position is considered as being the largest. Each part of the divided height of the molten metal $h_i$ is shown as $h_i$=iΔh(i=0, . . . n). Thus the rate of the flow of the molten metal that flows, $q=[q_0, q_1 \ldots q_n]^T$, for the height, $h=[h_0, h_1 \ldots h_n]^T$, is given by the following formula (17):

$$q=f(h) \tag{17}$$

wherein function f(h) is Bernoulli's theorem, shown in formula (10). Thus the inverse function of formula (17) is given by the following formula (18):

$$h=f^{-1}(q) \tag{18}$$

This expression (18) can be obtained by inverting the relationship of the input and output factors in expression (17). (h) in expression (18) is obtained from the "Lookup Table." Now, if $q_i \rightarrow q_{i+1}$, and $h_i \rightarrow h_{i+1}$, then the relationship can be expressed by a linear interpolation. If the width that is obtained after the height, $h_{max}$ [m], is divided, is narrower, the more precisely can be expressed the relationship of the rate of the flow of the molten metal, q [$m^3$/s], to the height h [m] above the outflow position. Thus it is desirable to make the width of the parts of the divided height as narrow as is practically possible.

The height of molten metal above the outflow position, $h_{ref}$ [m], which is to achieve the targeted flow pattern of the molten metal, $q_{ref}$ [$m^3$/s], is obtained from expression (18) and is shown by the following expression (19):

$$h_{ref}(t)=f^{-1}(q_{ref}(t)) \tag{19}$$

Also, given that the height of the molten metal above the outflow position is $h_{ref}$ [m], the volume of the molten metal above the outflow position, $V_{ref}$ [$m^3$], is shown by expression (20), which is obtained from expression (9).

$$V_{ref}(t)=A(\theta(t))h_{ref}(t) \tag{20}$$

Next, if the volume of the molten metal above the outflow position, $V_{ref}$ [$m^3$], as shown by expression (20), and the targeted flow pattern of the molten metal, $q_{ref}$ [$m^3$/s], are substituted for the values in the basic model expression (11) for the rate of the flow of the molten metal, then the following expression (21) is obtained. It shows the angular velocity of the tilting of the ladle 2, $\omega_{ref}$[degree/s]. This angular velocity is to achieve the targeted flow pattern of the molten metal.

$$\omega_{ref}(t) = -\frac{\frac{dV_{rref}(t)}{dt} + q_{ref}(t)}{\frac{\partial V_s(\theta(t))}{\partial\theta(t)}} \tag{21}$$

By solving in turn expressions (17) to (21) and substituting the angular velocity of the tilting of the ladle 2 that is obtained, $\omega_{ref}$[degree/s], for the values in expression (16), so as to produce the targeted flow pattern of the molten metal, $q_{ref}$ [$m^3$/s], the input voltage for control, u [V], which is to be supplied to the servomotors 3, 3, can be obtained.

Also, by using formula (15), the volume, $V_{ref}$ [$m^3$], of the molten metal above the outflow position which achieves the targeted pouring rate pattern, $q_{ref}$ [$m^3$/s], can be denoted by the following formula (22), $$V_{rref}(t) = \frac{3A(\theta(t))}{\left(2cL_f\sqrt{2g}\right)^{2/3}} q_{ref}(t)^{2/3} \tag{22}$$

Substitute both the volume of the molten metal above the outflow position, $V_{ref}$[$m^3$], which was obtained from expression (22), and the targeted flow pattern of the molten metal, $q_{ref}$[$m^3$/s], for the values in expression (21). Then the angular velocity of the tilting of the ladle 2, $\omega_{ref}$[degree/s], which is to achieve the targeted flow pattern of the molten metal, is obtained. Next, substitute the angular velocity of the tilting of the ladle 2 that was obtained, $\omega_{ref}$[degree/s], for the value of the inverse model of expression (16) for the servomotors 3, 3. Then the input voltage for control, u (V), that is to be supplied to the servomotors 3, 3, can be obtained.

In FIG. 5, $P_0$ shows the characteristics of the transfer from the flow rate of the liquid that flows out of the ladle to the position on which the molten metal drops in the pouring gate in the mold. Also, FIG. 7 illustrates a process in which a liquid flows out of the ladle and then flows into the mold.

Figure 7:
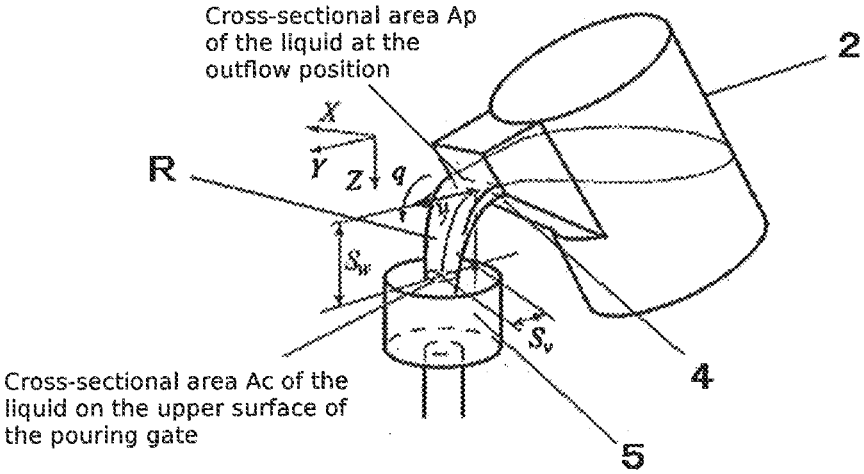
FIG. 7 illustrates the pouring process in the preceding example.

In FIG. 7, $S_w$ [m] shows the height from the outflow position 4 of the ladle to the pouring gate 5 in the mold. $S_v$ [m] shows the horizontal length from the outflow position 4 in the ladle to the position, on which the molten metal drops, on the upper surface of the pouring gate 5 in the mold. Ap [$m^2$] shows the cross-sectional area of the liquid at the tip of the outflow position 4 of the ladle. Ac [$m^2$] shows the cross-sectional area of the liquid dropping on the upper surface of the pouring gate 5 in the mold. The average flow rate $V_f$[m/s] of the flowing liquid R at the tip of the outflow position is given by the following formula (23).

$$v_f(h(t)) = \frac{q(h(t))}{A_p(h(t))} \tag{23}$$

$v_f$(h (t)) [m/s] depends on the height h(t) [m] of the liquid on the outflow position. Given that the cross-sectional area of the molten metal is constant during the pouring of the molten metal, the cross-sectional areas $A_p$ [$m^2$] and $A_c$ [$m^2$] are given by the following formula (24).

$$A_c(t+T_f)=A_p(t) \tag{24}$$

$T_f$ [s] shows the time for the liquid to drop from the tip of the outflow position of the ladle to the upper surface of the pouring gate. The positions $S_w$ [m] and $S_v$ [m], in which the liquid drops, are given by formulas (25) and (26).

$$s_v(t)=v_f(t_0)(t-t_0) \tag{25}$$

$$s_w(t)=\tfrac{1}{2}g(t-t_0)^2 \tag{26}$$

$t_0$ [s] shows the time when the flowing liquid passed through the tip of the outflow position of the ladle. The position of the tip of the outflow position does not change while the ladle is being tilted, when the servomotor for tilting the ladle is attached to the tip of the outflow position. However, the position of the tip of the outflow position is made to move circularly around the rotating shaft of the servomotor by tilting the ladle, when a servomotor for tilting the ladle is attached to the center of gravity of the ladle as in FIG. 1. So, the servomotor for moving the ladle up and down and the servomotor for moving the ladle back and forth are driven in conjunction with driving the servomotor for tilting the ladle. Thereby a system for control in which the position of the tip of the outflow position does not move can be built. Thereby the height of the tip of the outflow position of the ladle is kept constant. So, by using formula (26), the time for the molten metal to drop from the tip of the outflow position of the ladle to the upper surface of the pouring gate of the mold is given by the following formula (27).

$$T_f = t_1 - t_0 = \frac{\sqrt{2S_w}}{g} \tag{27}$$

$S_w$ [m] shows the height from the tip of the outflow position to the upper surface of the pouring gate in the mold when the system for control in which the position of the tip of the outflow position is kept constant by driving the servomotor for moving the ladle up and down and driving the servomotor for moving the ladle back and forth in conjunction with driving the servomotor for tilting the ladle. Also, $t_1$ [s] shows the time for the liquid to reach the pouring gate. From formula (25) and formula (27), the position on which the liquid drops in the horizontal direction on the upper surface of the pouring gate in the mold is given by the following formula (28).

$$S_v = v_f(t_0)\frac{\sqrt{2S_w}}{g} \tag{28}$$

In the estimating device for estimating the flow rate $E_f$, the estimated flow rate, $v_f$(t) [m/s], which is denoted by using v with a bar, is obtained by using the following formula (29).

$$\bar{v}_f(t) = \frac{q_{ref}(t)}{A_p(\bar{h}(t))}. \tag{29}$$

The cross-sectional area Ap [$m^2$] is obtained from the shape of the tip of the outflow position and from the height h [m] of the liquid at the tip of the outflow position. So, the estimated height of the liquid, h(t) [m], which is denoted by using h with a bar, in relation to the targeted flow rate, can be obtained by expressing the height by using the inverse problem of Bernoulli's theorem shown in formula (30). The inverse problem, in which the height of the liquid is obtained from the flow rate, is shown in formula (31), $$q(t) = c\int_0^{h(t)} \left(L_f(h_b)\sqrt{2gh_b}\right)dh_b \tag{30}$$

$$\bar{h}(t) = f^{-1}(q_{ref}(t)) \tag{31}$$

In formula (30), $L_f$ shows the width of the outflow position at its tip as in FIG. 4. The liquid has a depth $h_b$ [m] at the outflow position. Formula (31) can be obtained by creating an input/output table by using formula (30), which is a forward problem, and then by interchanging the input and the output. Also, the cross-sectional area can be obtained by using formula (32) and from the shape of the outflow position.

$$A_p(\bar{h}(t)) = \int_0^{h(t)} L_f(h_b)dh_b \tag{32}$$

Thus the flow rate can be estimated by using formulas (29), (31), and (32). In the estimating device $E_o$ for estimating the position on which the molten metal drops, the estimated position of the drop, $S_v(t)$ [m], which is denoted by using S with a bar, can be obtained by assigning the estimated flow rate, which is Obtained by using formula (29), in formula (28). The position-controller Gy is a position-controlling system that moves the ladle back and forth such that the difference between the estimated position of the drop and the targeted position of the drop is caused to converge to 0. The liquid can be accurately poured on the targeted position in the pouring gate in the mold when the estimated position is given to the system for controlling the position.

Figure 8:
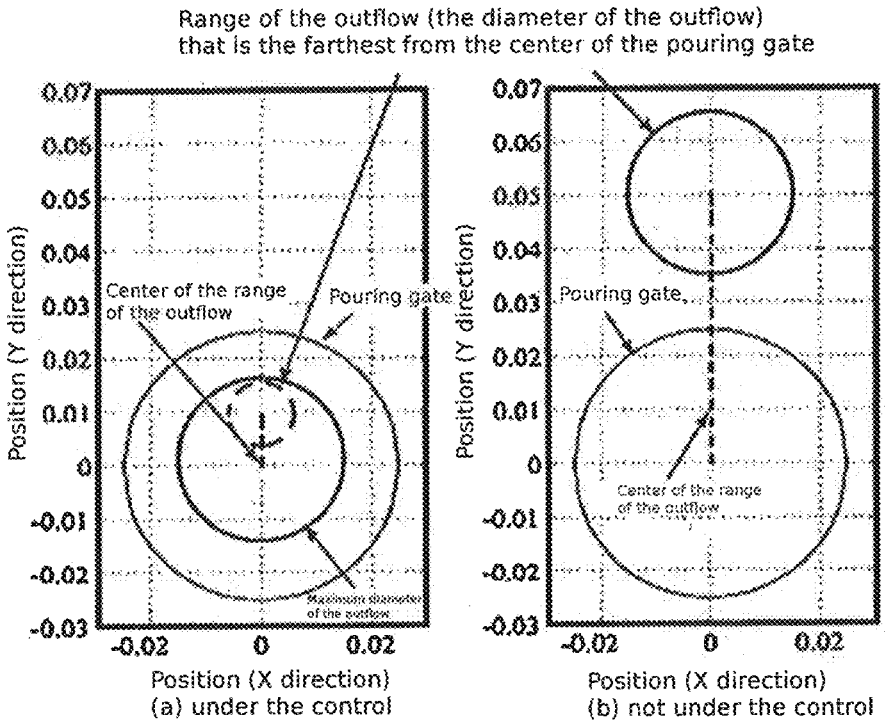
FIG. 8 illustrates a simulated area of the poured position.

To show the availability of the system for controlling the position on which molten metal drops, the area obtained by drawing the position on which molten metal drops by using a simulation is shown in FIG. 8, FIG. 8 illustrates the pouring system as projected from its upper surface. In the figure, (a) shows the result obtained by using the system for controlling the position on which molten metal drops. (b) shows the result without using the system. The narrow line shows the cup of the pouring gate. The heavy line shows the range of the outflow (the diameter of the outflow) that is the farthest from the center of the pouring gate. The broken line shows the area when the center of the position on which the liquid drops is the farthest from the center of the pouring gate. From these results, it is confirmed that the liquid dropped into the pouring gate when the system for controlling the position on which the liquid drops is used, even if the pouring is quickly carried out.

As above, the preceding example for accurately pouring the molten metal that flows out of the ladle into the pouring gate in the mold by using a method in which (1) the mathematical model of the area on which the molten metal that flows from the ladle will drop is produced, (2) the inverse problem of the produced mathematical model is solved, and (3) the position on which the molten metal drops is estimated by means of the estimating device for estimating the pouring rate and the estimating device for estimating the position on which the molten metal drops, was explained with reference to FIGS. 1 to 8. Next, the tilting-type automatic pouring apparatus and method of the present invention for more accurately dropping the molten metal into the pouring gate in the mold is explained with reference to FIGS. 9, 10, and 11. Incidentally; the configuration of the preceding example shown in FIGS. 5 and 10 is partially in common with that of the tilting-type automatic pouring apparatus and method of the present invention. Below the detailed explanation of the common configuration will be omitted as long as such an explanation is not required. Incidentally, the apparatus and the method of the present invention have been made to solve "the problem (1) wherein the position on which, the molten metal drops cannot be accurately controlled to a sufficient degree when an error in the estimated position on which the molten metal drops occurs and (2) wherein the error also occurs because neither the effect of the guiding member at the outflow position nor the effect of a contracted flow is taken into consideration," neither of which can be solved by a feedforward control like in the preceding example. The apparatus and method of the present invention, as explained below, have been made in view of the unsolved problem in the preceding example. The molten metal can be accurately poured by using the apparatus or the method, even if an error in the estimated position occurs. This is because the position on which the liquid that flows out of the ladle is measured by a video camera, and the ladle can move to compensate for the error. Also, the present method for automatically pouring molten metal by tilting a ladle can to a sufficient degree accurately estimate the position on which the molten metal will drop and can accurately move the position on which the molten metal drops to a targeted position. This is because the position on which the molten metal drops is estimated in view of the effect of the guiding member at the pouring gate and the effect of a contracted flow. In other words, as explained in more detail below, in the method of the present invention as shown in FIG. 10, the error itself in giving the position on which the molten metal drops can be reduced. This because the flow rate, etc., is determined in view of the effect of a contracted flow and the effect of the guiding member. Also, even if such an error occurs, the position for pouring the molten metal can be accurately controlled by using a feedback based on a measurement of the position on which molten metal drops, by a video camera.

[2. The Apparatus for Automatically Pouring Molten Metal by Tilting a Ladle of the Present Invention]

Figure 9:
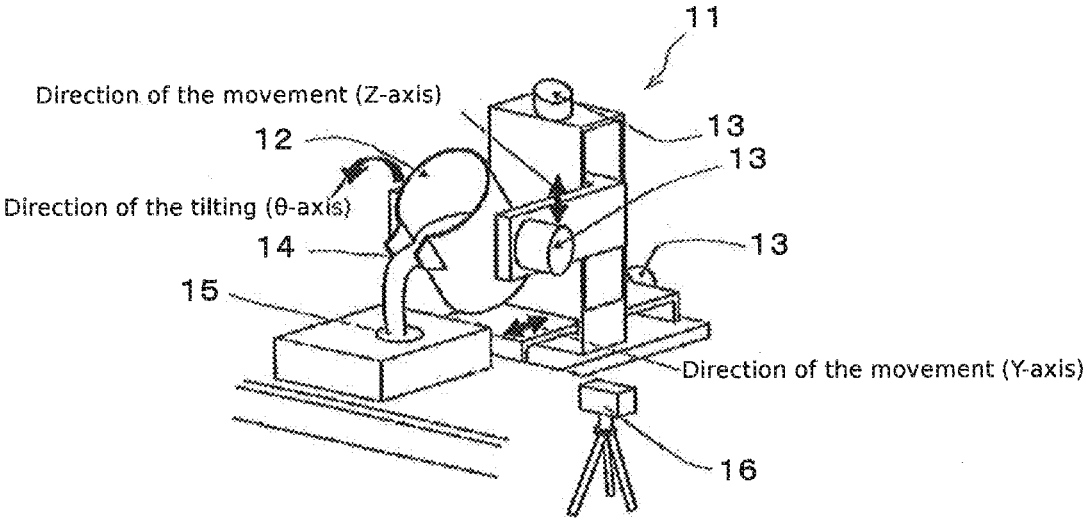
FIG. 9 schematically illustrates the tilting-type automatic pouring apparatus used in the present invention.
Figure 10:
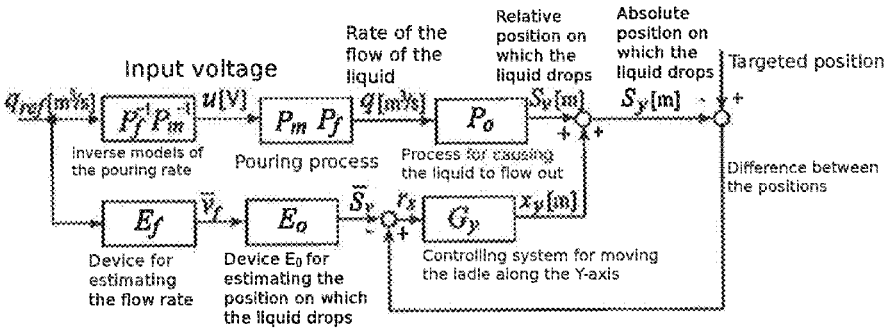
FIG. 10 is a block diagram illustrating a system for controlling the position on which molten metal drops in the present invention.

The apparatus shown in FIG. 9 is a schematic diagram of the apparatus of the present invention for automatically pouring molten metal by tilting a ladle. The apparatus 11 for automatically pouring molten metal by tilting a ladle has a ladle 12. The ladle 12 can tilt, move back and forth, and move up and down, by means of the servomotors 13, 13. The servomotors 13, 13 are installed in respective positions in the apparatus 11. The movements in the forward and backward directions are carried out by transporting the ladle 12 in the direction of the Y-axis in FIG. 9. The movements in the upward and downward directions are carried out by transporting the ladle 12 in the direction of the Z-axis in FIG. 9. The tilt of the ladle 12 is carried out by rotating it in the direction around the θ-axis in FIG. 9. The θ-axis is approximately orthogonal to the Y-axis and the Z-axis. The molten metal is dropped from the outflow position 14 onto the pouring gate 15 in the mold by tilting the ladle 12, by moving the ladle 12 back and forth, and by moving the ladle 12 up and down. Also, rotary encoders are attached to the respective servomotors. Thereby the position and the angle of the ladle 12 can be measured. A video camera 16, which serves as an imaging device, is installed at the side of the apparatus 11. Thereby the position on which the liquid that flows out of the guiding member drops can be measured, even when the guiding member is provided in the outflow position 14 of the ladle 12. Further, the servomotors 13, 13 receive control command signals from a computer. Incidentally, the computer may be a motion controller, such as a personal computer, a microcomputer, a programmable logic controller (PLC), or a digital signal processor (DSP).

Figure 11:
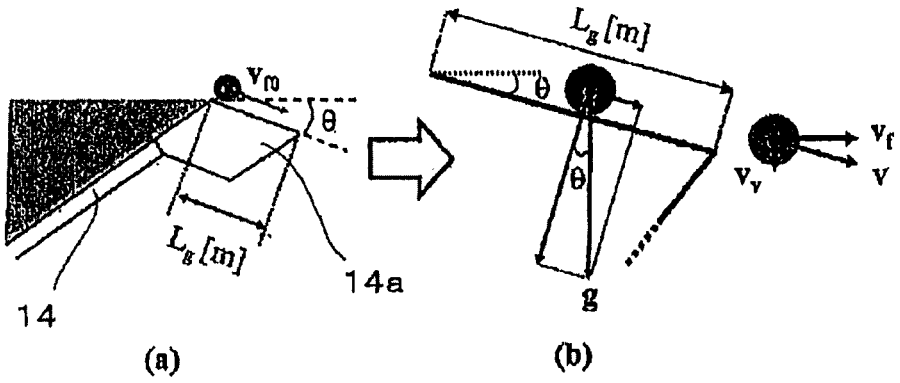
FIG. 11 is a sectional view illustrating the flow rate of the molten metal when it goes into the guiding member of the outflow position.

The system, as in FIG. 10, for controlling the position on which the molten metal drops, was built for the apparatus, as in FIG. 9, for automatically pouring molten metal by tilting a ladle. In FIG. 10, $P_m$ is the dynamic characteristic of the motor for tilting a ladle. $P_m$ can be denoted by the following formula:

$$T\frac{d\omega}{dt} + \omega = Ku \tag{33}$$

$$\theta = \int \omega dt \tag{34}$$

wherein ω [degree/s] shows the angular velocity of the tilting, u[V] shows the input voltage, T [s] shows the time constant, and K [deg/s/V] shows the gain constant. θ [degree] shows the angle of the tilting. Also, in FIG. 10, $P_f$ shows the process for causing the liquid to flow out of a ladle by tilting the ladle. $P_f$ is denoted by the following formula:

$$\frac{dV_r(t)}{dt} = -q(t) - \frac{\partial V_s(\theta(t))}{\partial \theta(t)}\omega(t) \tag{35}$$

$$h(t) = \frac{V_r(t)}{A(\theta(t))} \tag{36}$$

$$q(t) = c\int_0^{h(t)} L_f(h_b)\sqrt{2gh_b}\,dh_b \tag{37}$$

wherein $V_r$ [$m^3$] shows the volume of the liquid above the outflow position, q [$m^3/s$] shows the pouring rate, $V_s$ [$m^3/s$] shows the volume of the liquid below the outflow position, h [m] shows the height of the liquid above the outflow position, A [$m^2$] shows the area of the liquid on the horizontal plane on which the tip of the outflow position is included, $h_b$ [m] shows the depth, which is measured from the surface, of the liquid in the ladle, $L_f$ [m] shows the width of the outflow position, g [$m/s^2$] shows the gravitational acceleration, and c shows the flow coefficient. The process $P_0$ for causing a liquid to flow out in FIG. 10 is denoted by the following formula:

$$v_{f0} = \alpha_1\left(\frac{q(t)}{A_p(h(t))}\right) + \alpha_0 \tag{38}$$

$$v(t) = \sqrt{v_{f0}^2 + 2L_g g\sin\theta} \tag{39}$$

$$v_f(t) = v\cos\theta \tag{40}$$

$$T_f = \frac{-v\sin\theta + \sqrt{(v\sin\theta)^2 + 2S_w g}}{g} \tag{41}$$

$$S_v = v_f T_f \tag{42}$$

wherein, as shown in FIG. 11, $v_{f0}$ [m/s] is the flow rate of the liquid in the ladle when it goes into the guiding member 14*a* of the outflow position 14, and $A_p$ [$m^2$] is the area of the cross-section of the liquid at the outflow position. $\alpha_0$ and $\alpha_1$ are the influence coefficients when because of gravity the liquid that flows out of the ladle becomes a contracted flow, $L_g$ [m] is the length of the guiding member of the outflow position, v [m/s] is the rate of the flow of the liquid when it flows out of the guiding member at the outflow position, $v_f$ [m/s] is the horizontal flow rate of the liquid when it flows out of the guiding member at the outflow position, $T_f$ [s] is the time for the liquid that flows from the outflow position to fall, $S_w$ [m] shows the vertical distance from the outflow position, and $S_v$ [m] shows the horizontal distance from the outflow position. Assuming that the vertical distance, which is measured as a vertical length from the upper surface of the pouring gate of the mold to the outflow position, is $S_w$ [m], then the horizontal distance, $S_v$ [m], which is measured as a horizontal length from the outflow position to the position on which the liquid drops, can be obtained.

The inverse model in FIG. 10 of the flow rate can be obtained by using formulas (33) to (37). By using formula (37), the height of the liquid above the outflow position, $h_{ref}$ [m], that achieves the targeted pouring rate $q_{ref}$, [$m^3/s$], can be obtained by using the following formula.

$$h_{ref}(t) = f^{-1}(q_{ref}(t)) \tag{43}$$

The height of the liquid above the outflow position, $h_{ref}$ [m], that gives the volume of the liquid above the outflow position, $V_{rref}$ [$m^3$], can be obtained by using the following formula based on formula (36).

$$V_{rref}(t) = A((\theta(t))h_{ref}(t) \tag{44}$$

From formula (35), it is seen that the angular velocity for tilting the ladle, $\omega_{ref}$ [degree/s], that achieves the targeted pouring rate, can be denoted by the following formula.

$$\omega_{ref}(t) = \frac{\frac{dV_{ref}(t)}{dt} + q_{ref}(t)}{\frac{\partial V_f(\theta(t))}{\partial \theta(t)}} \tag{45}$$

From formula (33), it is seen that the inverse model of the motor can be denoted by the following formula.

$$u = \frac{T}{K}\frac{d\omega}{dt} + \frac{1}{K}\omega \tag{46}$$

The input voltage transmitted to the motor, u[V], that achieves the targeted pouring rate, can be obtained by in turn using formulas (43) to (46).

The position on which the liquid that flows out of the ladle will drop can be estimated by using the targeted flow rate, because the targeted pouring rate is achieved by using the inverse model of formulas (43) to (46). Formulas (38), (39), and (40) are input in the block $E_f$ for estimating the horizontal flow rate, $v_f$ [m/s], of the liquid that flows out of the outflow position as in FIG. 10. Thus the horizontal flow rate, of [m/s], of the flow of the liquid that flows out of the outflow position, can be estimated by inputting a targeted pouring rate in the block $E_f$. Also, formulas (41) and (42) are input in the block $E_o$ for estimating the horizontal distance from the outflow position to the position on which the liquid drops. The position on which the liquid drops can be estimated by inputting the estimated horizontal flow rate, $v_f$ [m/s], in the block $E_o$. The position on which the liquid drops can be controlled by moving the ladle depending on the estimated position on which the liquid will drop. Namely, for example, the ladle can be controlled to move such that the estimated position on which the liquid will drop coincides with the position of the pouring gate of the mold.

The relative position on which the liquid drops in FIG. 10 means a horizontal position on which the liquid drops in relation to the outflow position. If the ladle moves horizontally, the coordinates in relation to the position of the tip of the outflow position will also be changed along with the movement of the ladle. The absolute position on which the liquid drops means a horizontal position on which the liquid drops in the fixed coordinates measured by means of a camera. The targeted position is given in the fixed coordinates measured by means of a camera to obtain the difference between the targeted position and the position on which the liquid dropped. The targeted position is the parameters that are given by an operator, such as the position of the center of the pouring gate. The feedback control is carried out to move the ladle such that the difference between those positions is corrected. Thereby, even if the estimated position on which the liquid will drop is erroneously estimated by the blocks $E_f$ and $E_o$ in FIG. 10, the erroneously estimated position can be compensated for by carrying out the feedback control for correcting the position on the liquid drops by using a camera.

As stated above, in the apparatus and method of the present invention for automatically pouring molten metal by tilting a ladle that retains the molten metal, when the molten metal is poured into the mold by tilting the ladle of the automatic pouring apparatus comprising three servomotors, one of which can tilt the ladle, one of which can move the ladle back and forth, and one of which can move the ladle up and down, the input voltages transmitted to the servomotor that tilts the ladle, the servomotor that moves the ladle back and forth, and the servomotor that moves the ladle up and down, are controlled by using a computer, in order to accurately drop the molten metal that flows out of the guiding member, which is installed at the outflow position of the ladle, into the pouring gate in the mold. The mathematical model of the area on which the molten metal that flows from the ladle will drop is produced and then the inverse problem of the produced mathematical model is solved. In view of the effect of the guiding member in the outflow position and the effect of the contracted flow, the position on which molten metal drops is estimated by the estimating device for estimating the pouring rate and the estimating device for estimating the position on which the molten metal will drop. Then the estimated position is calculated by a computer. Thereby the respective input voltages transmitted to the servomotor that tilts the ladle, the servomotor that moves the ladle back and forth, and the servomotor that moves the ladle up and down, are obtained. The three servomotors are controlled based on the respective input voltages. Namely, by considering the effect of a contracted flow and the influence of the guiding member as in formulas (38) and (39), a more accurate feedforward control can be carried out than in the preceding example. For example, the area of the cross-section of the flowing liquid in the outflow position can be reduced, because the liquid can become a contracted flow. Thereby the average flow rate of the liquid can increase. Thus, if the effect of the contracted flow is not considered, the position on which the liquid drops can be erroneously estimated because of the increased flow rate. However, the error can be reduced in the present invention. Incidentally, any error of the estimated position can be corrected by using a feedback control in addition to using the feedforward control, to more accurately control the position on which the liquid drops. Namely, if the measured position on which the liquid will drop differs from the estimated positions on which the liquid drops when the position on which the molten metal that flows from the ladle dropped is measured by means of an imaging device that is installed at the side of the ladle, the difference can be reduced. Thereby the molten metal can be accurately dropped onto the target position. This is also the characteristic of the present invention. Also, the present invention is applied also to a program for carrying out the above control of the pouring process by means of a computer and to a medium that records the program that can be read by a computer. The present invention, which has such a configuration, can carry out a more accurate feedforward control by considering the effect of the guiding member of the pouring gate or the effect of the contracted flow or both of them. The molten metal that flows from the ladle can be accurately poured into the pouring gate in the mold by moving the ladle back and forth based on the feedforward control to control the position on which the molten metal drops. Thereby the molten metal does not drop outside the pouring gate in the mold. Thus there is an advantage in that the pouring can be carried out safely and without wasting molten metal.

Also, the ladle is installed in the automatic pouring apparatus of the present invention. The ladle can be tilted, can be moved back and forth, and can be moved up and down, by means of the respective servomotors installed in the positions in the apparatus. Also, the position and the angle of the ladle can be measured, because the rotary encoders are attached to the servomotors. The positions on which the liquid that flows out of the ladle drops can be measured, because a video camera is installed at the side of the apparatus. The present automatic pouring apparatus comprises a motion controller that estimates the relative position on which the liquid that flows out of the ladle drops in relation to the position of the apparatus. Also, the motion controller gives a command signal for moving the ladle to the automatic pouring apparatus such that the estimated position on which molten metal will drop will coincide with the targeted position. The present apparatus is further characterized in that, even when the position on which molten metal will drop is erroneously estimated, the difference between the position on which the molten metal drops and the targeted position is calculated from an image obtained by a camera, and then a command signal for moving a ladle such that the difference is reduced (the error of the targeted position is reduced) is given. The apparatus and method can more accurately estimate the position on which molten metal will drop than can the conventional control. In addition, even if the position on which the molten metal drops is erroneously estimated, the apparatus and method can calculate the difference between the estimated position and the targeted position from an image obtained by a camera. Also, they can move the ladle such that the difference is reduced. Thereby the position on which the molten metal drops can be caused to coincide accurately with the targeted position.

Figure 12:
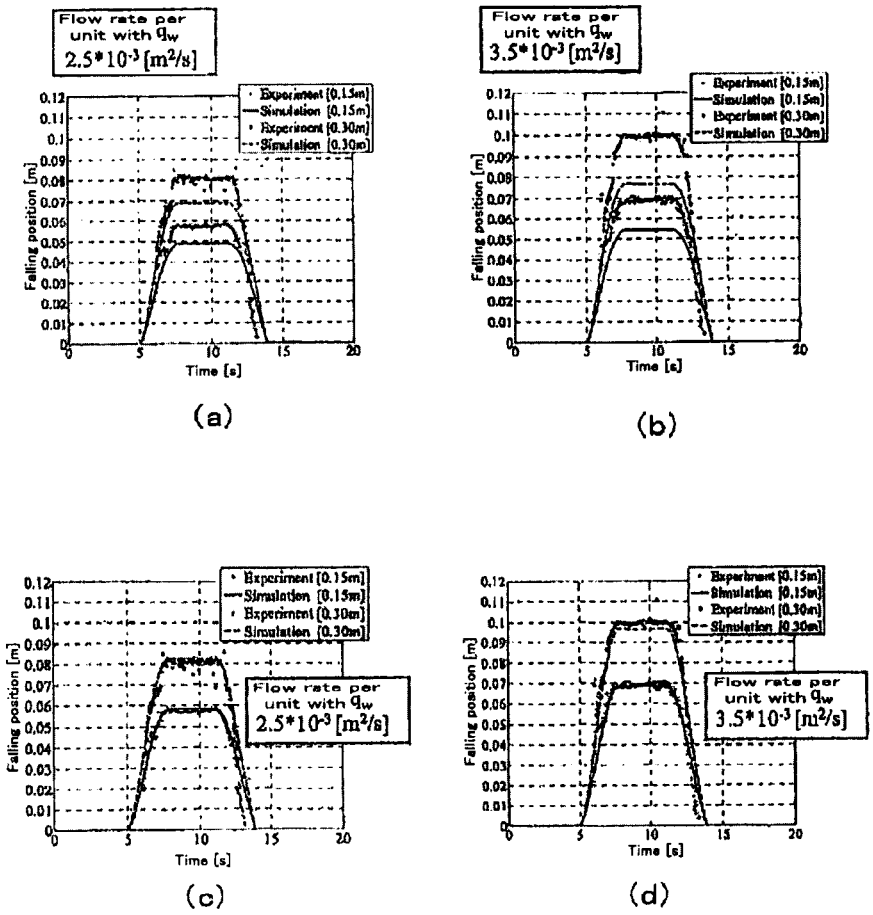
FIG. 12 illustrates the simulations and experiments of the present invention and a preceding example.

Next, to illustrate the availability of the system of the present invention for controlling the position on which molten metal drops, the results of the simulations and the experiments will be shown in FIG. 12. FIGS. 12 (*a*) and 12 (*b*) show the results of the simulations and the experiments of the preceding example explained with reference to FIGS. 1 to 8. The flow rate per unit width was $qw=2.5\times10^{-3}$ [$m^2/s$] and $3.5\times10^{-3}$ [$m^2/s$] in each case. FIGS. 12 (*c*) and 12 (*d*) show the results of the simulations and the experiments of the present invention explained with reference to FIGS. 9, 10, and 11. (The effects of the contracted flow and the guiding member are considered in the simulations and the experiments.) The flow rate per unit width was $qw=2.5\times10^{-3}$ [$m^2/s$] and $3.5\times10^{-3}$ [$m^2/s$] in each case. These results have confirmed that the position on which molten metal drops can be accurately estimated in the present invention, in which the effect of the guiding member in the outflow position and the effect of the contracted flow are considered.

The present invention can improve the speed and the accuracy of the tilting-type automatic pouring method used in many pouring steps in the casting industry. The speed and the accuracy of the conventional automatic pouring apparatus in which a ladle is tilted can be improved by applying the present invention to it. Also, the present invention is advantageous because it is applicable to various shaped ladles, So, the industrial applicability of the present invention in the casting industry is excellent.

DENOTATION OF THE REFERENCE NUMBERS

11 Tilting-type Automatic Pouring Apparatus
12 Ladle
13 Servomotors
14 Outflow Position
15 Pouring Gate in a Mold
16 Video Camera

What we claim is:

1. A method for automatically pouring molten metal by tilting a ladle for storing the molten metal in a tilting-type automatic pouring apparatus comprising three servomotors, one of which can tilt the ladle, one of which can move the ladle back and forth, and one of which can move the ladle up and down, wherein respective input voltages transmitted to the three servomotors are controlled by means of a computer whereby molten metal that flows from the ladle is correctly dropped into a pouring gate in a mold when the molten metal is poured into the mold, wherein the method comprises:

producing a mathematical model of an area on which the molten metal that flows from the ladle will drop, solving an inverse problem of the produced mathematical model in view of an effect of a contracted flow causing, under the effect of gravity, a reduction of a depth of an overflow of the molten metal at a guiding member of a tip of an outflow position on a flow rate of the molten metal when it flows out of the guiding member by means of an estimating device for estimating a flow rate of the poured molten metal and by means of an estimating device for estimating a position on which the molten metal will drop, to estimate a position on which the molten metal will drop, calculating the estimated position by means of a computer, to thereby obtain respective input voltages transmitted to the three servomotors, controlling the three servomotors based on the obtained input voltages, and measuring a position on which the molten metal that flows from the ladle is dropped by means of an imaging device installed at a side of the ladle.

2. The method of claim 1, wherein the estimated position on which the molten metal will drop is estimated further in view of an effect of the guiding member in addition to the effect caused by a contracted flow.

3. The method of claim 2, wherein the method further comprises:

compensating for a difference between the measured position and the estimated position whereby the molten metal is correctly dropped on a desired position.

4. A non-transitory computer readable medium that records a program for controlling automatic pouring of molten metal by tilting a ladle for storing the molten metal in a tilting-type automatic pouring apparatus comprising three servomotors, one of which can tilt the ladle, one of which can move the ladle back and forth, and one of which can move the ladle up and down, wherein respective input voltages transmitted to the three servomotors are controlled by means of a computer whereby molten metal that flows from the ladle is correctly dropped into a pouring gate in a mold when the molten metal is poured into the mold, wherein the program comprises:

producing a mathematical model of an area on which the molten metal that flows from the ladle will drop, solving an inverse problem of the produced mathematical model in view of an effect of a contracted flow causing, under the effect of gravity, a reduction of a depth of an overflow of the molten metal at a guiding member of a tip of an outflow position on a flow rate of the molten metal when it flows out of the guiding member by means of an estimating device for estimating a flow rate of the poured molten metal and by means of an estimating device for estimating a position on which the molten metal will drop, to estimate a position on which the molten metal will drop, calculating the estimated position by means of a computer to thereby obtain respective input voltages transmitted to the three servomotors, controlling the three servomotors based on the obtained input voltages, and measuring a position on which the molten metal that flows from the ladle is dropped by means of an imaging device installed at a side of the ladle.

5. The non-transitory computer readable medium of claim 4, wherein the estimated position on which the molten metal will drop is estimated further in view of an effect of the guiding member in addition to the effect by a contracted flow.

6. The non-transitory computer readable medium of claim 5, wherein the program further comprises:

compensating for a difference between the measured position and the estimated position whereby the molten metal is correctly dropped on a desired position.

* * * * *